US007338256B2

(12) United States Patent
Kuo et al.

(10) Patent No.: US 7,338,256 B2
(45) Date of Patent: Mar. 4, 2008

(54) BLOWER

(75) Inventors: Yu-Chien Kuo, Taoyuan Hsien (TW); Tsu Liang Lin, Taoyuan Hsien (TW); Ming-Shi Tsai, Taoyuan Hsien (TW); Wen-Shi Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/316,732

(22) Filed: Dec. 27, 2005

(65) Prior Publication Data

US 2006/0165525 A1 Jul. 27, 2006

(30) Foreign Application Priority Data

Jan. 27, 2005 (TW) ..... 94102459 A

(51) Int. Cl.
*F04D 29/40* (2006.01)

(52) U.S. Cl. ..... 415/206; 415/212.1

(58) Field of Classification Search ..... 415/206, 415/203, 221, 212.1, 204
See application file for complete search history.

(56) References Cited

U.S. PATENT DOCUMENTS 5,813,834 A * 9/1998 Hopfensperger et al. ... 415/206
6,884,033 B2 * 4/2005 Liao ..... 415/206
6,964,556 B2 * 11/2005 Chiu et al. ..... 415/205

* cited by examiner

*Primary Examiner*—Edward K. Look
*Assistant Examiner*—Dwayne J White
(74) *Attorney, Agent, or Firm*—Birch, Stewart, Kolasch & Birch, LLP

(57) ABSTRACT

A blower comprises a housing and an impeller. The housing comprises a side outlet and an inlet comprising a predetermined profile, and the impeller is disposed in the housing. The predetermined profile is quadratrical, elliptical, polygonal, non-coaxial circle, or irregularly closed shaped. A flow tunnel is disposed between the impeller and the housing.

15 Claims, 8 Drawing Sheets

100

BLOWER

BACKGROUND OF THE INVENTION

1. Field of the Invention

The invention relates to a blower, and in particular to a blower preventing an air leakage and increasing an air pressure.

2. Description of the Related Art

Blowers are often employed to provide high air pressure to a system requiring high backpressure. In FIG. 1, a blower 10 comprises a first housing 12*a* and a second housing 12*b* second, wherein the first housing 12*a* having a first inlet 14 and an impeller 16. The second housing 12*b* has a second inlet 11 and a rounded region 100. A side outlet 13 is formed whereby the second housing 12*b* and the first housing 12*a* integrate together.

Usually, the profile of the first inlets 14 and the second inlet 11 is circle and are concentric with the impeller 16. The first and the second housings 12*a* and 12*b* cover the rounded region 100, to produce airflow. The first inlets 14 and the second inlet 11, however, are not covered by the first and the second housings 12*a* and 12*b*, allowing an airflow, leakage via the first inlets 14 and the second 11 when the impeller 16 is rotated at high speed, resulting in reduced pressure.

SUMMARY OF THE INVENTION

The invention provides a blower comprising a housing and an impeller, wherein the impeller disposed in the housing. The housing includes a side outlet and an inlet with a predetermined profile. The predetermined profile is quadratrical, elliptical, polygonal, non-coaxial circle, or irregularly closed shaped. A flow tunnel is disposed between the impeller and the housing.

The invention further provides a main inlet and a secondary inlet, wherein the secondary inlet extends outwardly from the periphery of the main inlet. The housing further comprises a plurality of outer frames assembled by coupling, riveting, engaging, or adhesion.

The invention employs the inlets in different positions with varied shapes to cover an extended flow tunnel toward the blades of the impeller, to prevent an airflow leakage via the inlets when the impeller is rotated at high speed and maintain airflow pressure.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the subsequent detailed description and the accompanying drawings, which are given by way of illustration only, and thus are not limitative of the present invention, and wherein.

DETAILED DESCRIPTION OF THE PREFERRED EMDBODIMENTS

Figure 1:
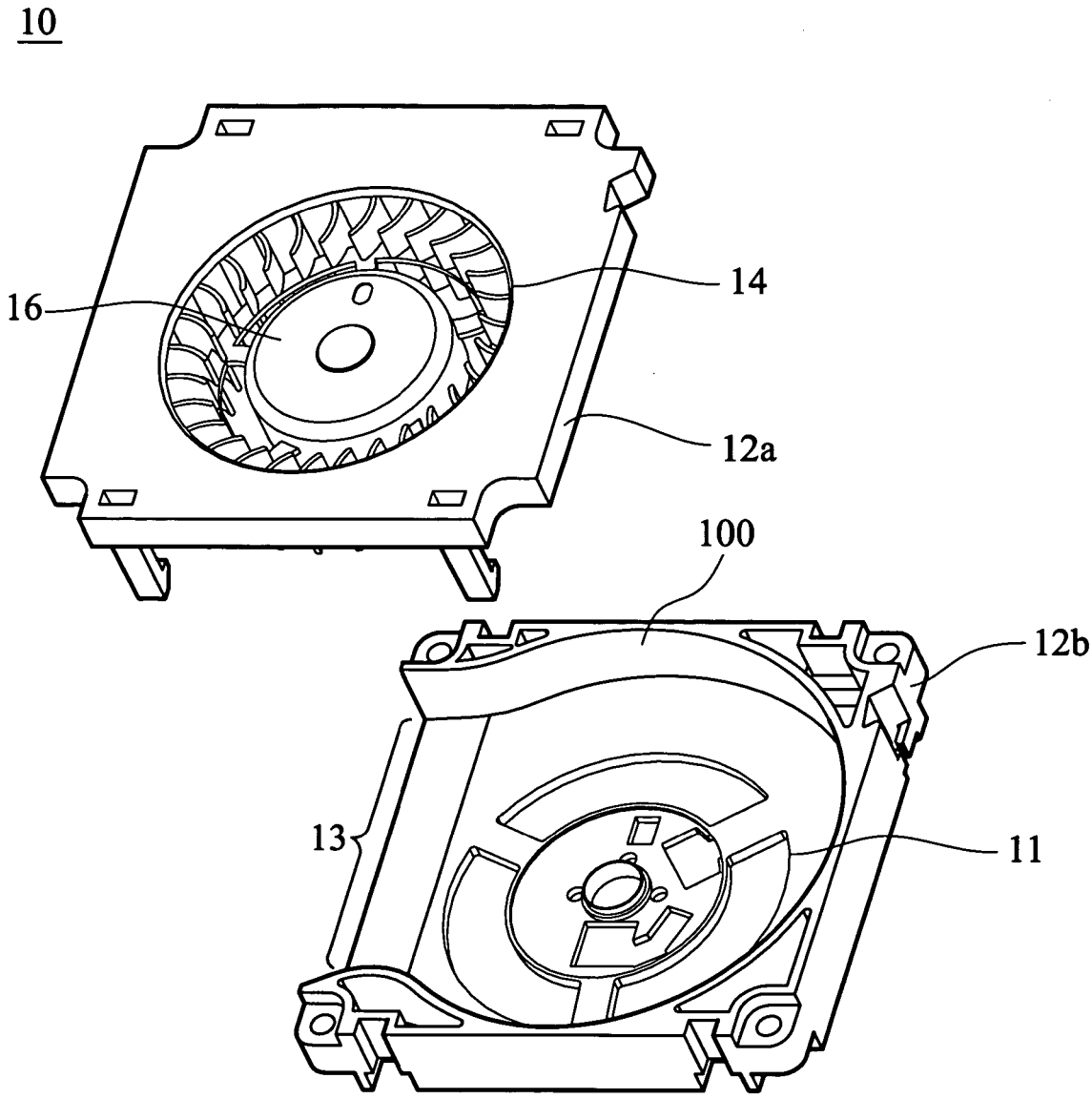
FIG. 1 (RELATED ART)
FIG. 1 is a schematic view of a conventional blower.
Figure 2A:
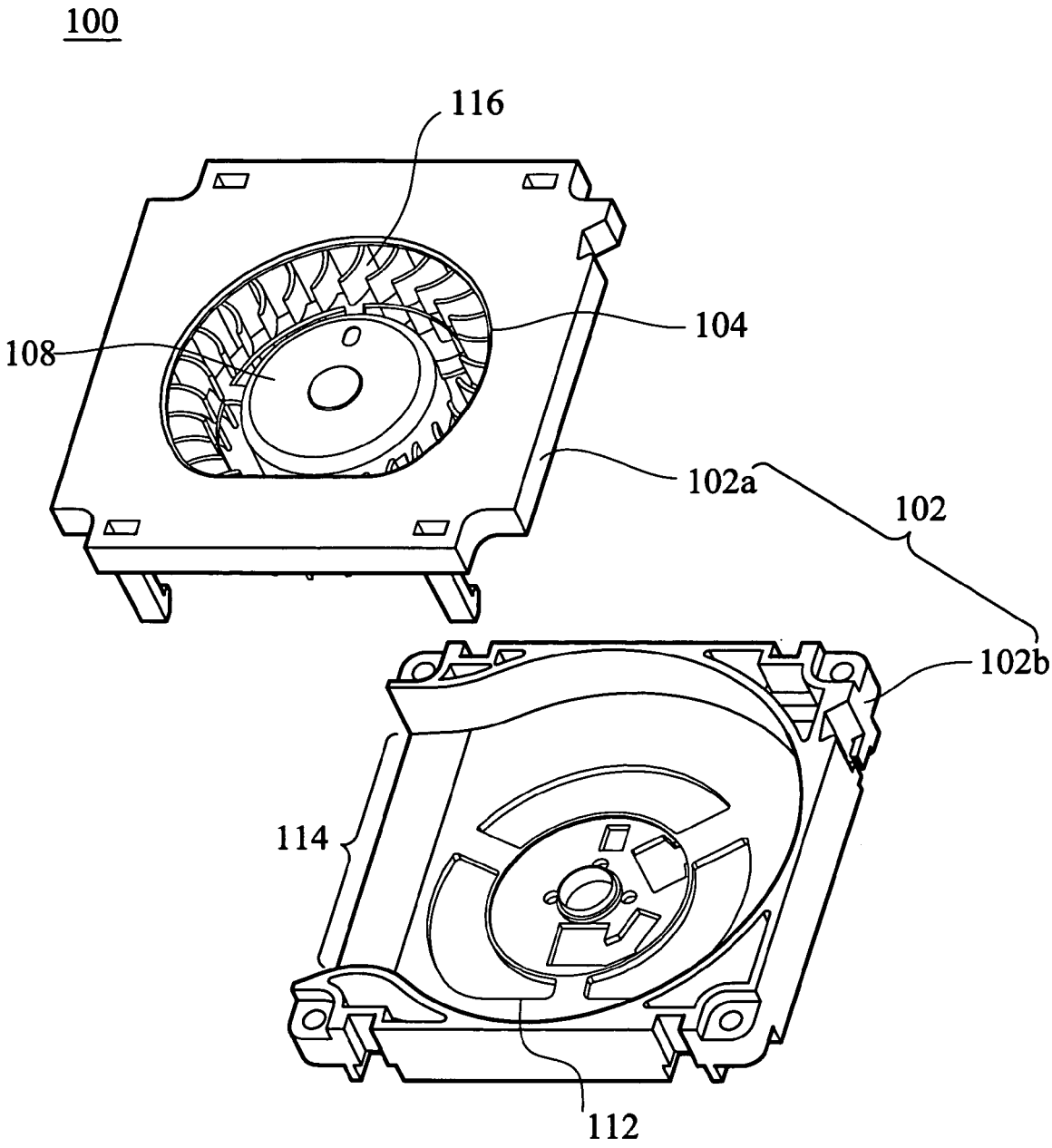
FIGS. 2A and 2B are schematic views of a blower of a first embodiment of the invention.
Figure 2B:
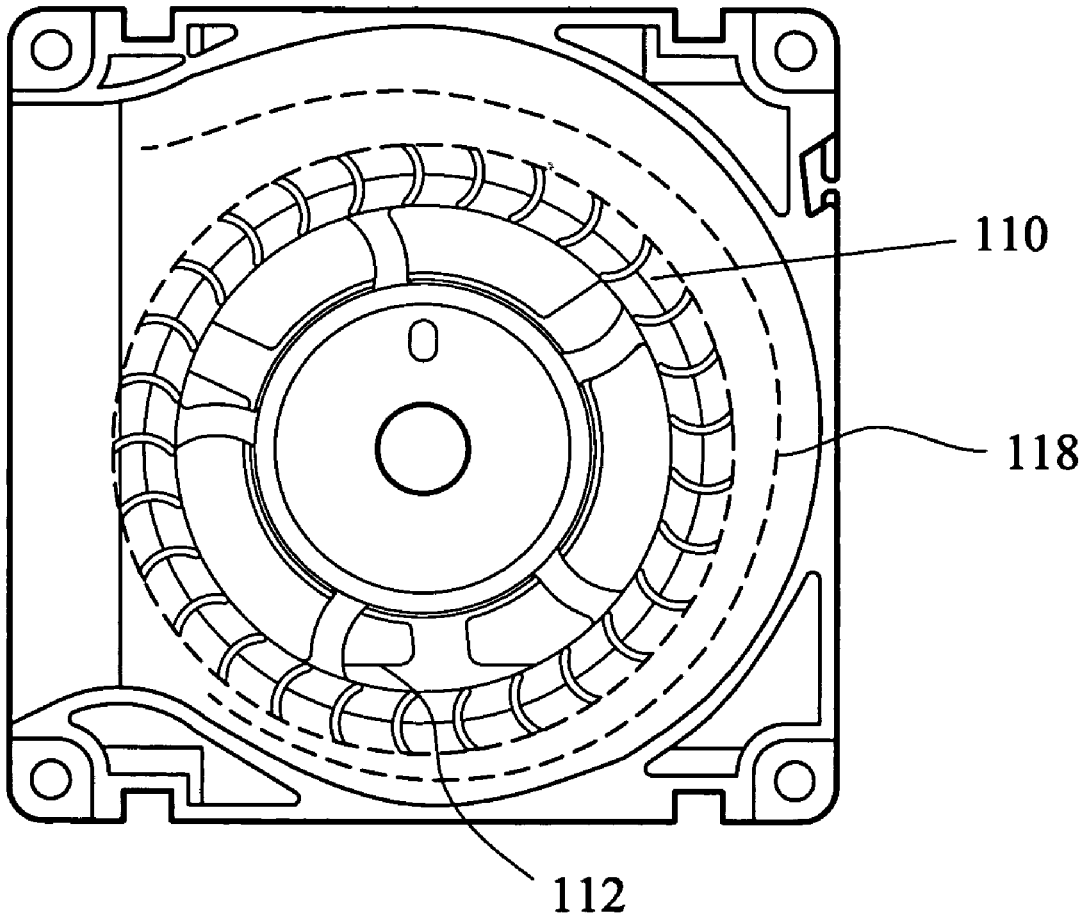

In FIGS. 2A and 2B, a blower 100 of a first embodiment of the invention comprises a housing 102 and an impeller 108 disposed in the housing 102. A flow tunnel 118 is formed between the impeller 108 and the housing 102.

The housing 102 comprises a first frame 102*a*, a second frame 102*b*, a first inlet 104, a second inlet 112 and a side outlet 114. The first frame 102*a* and the second frame 102*b* are assembled by coupling, riveting, engaging, or adhesion.

Figure 3A:
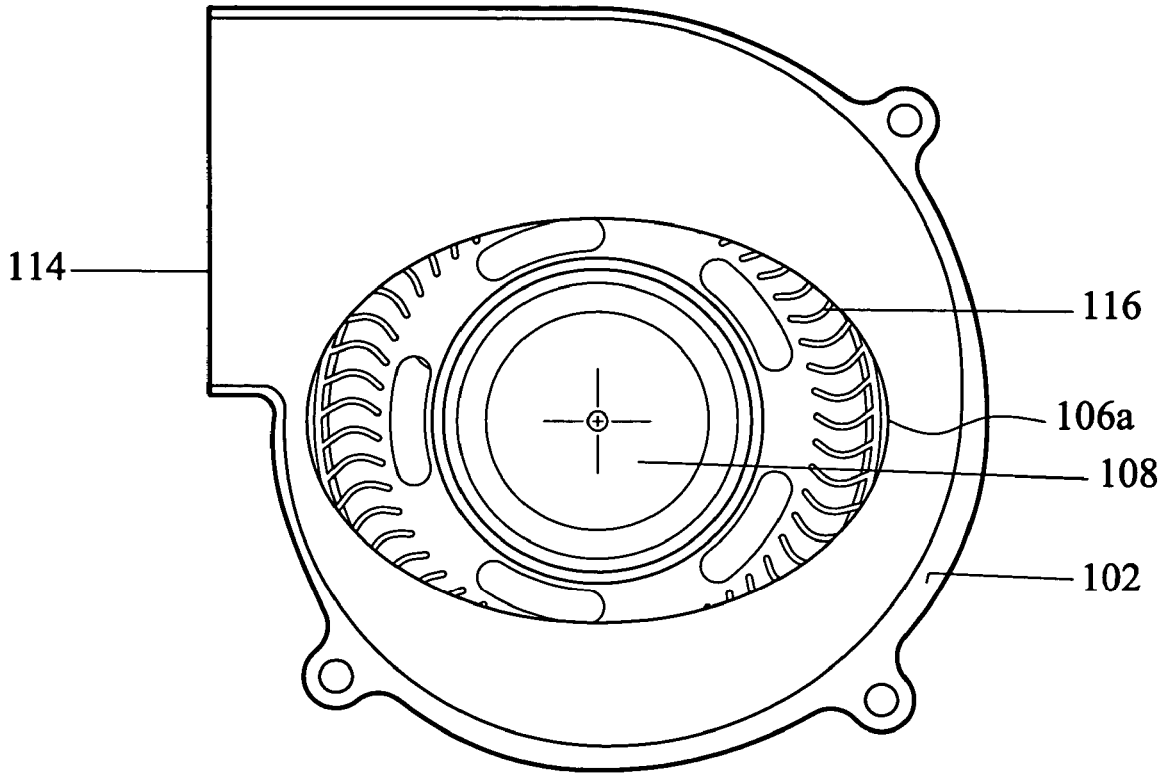
FIGS. 3A to 3C are schematic views of the blower of the first embodiment of the invention.
Figure 3B:
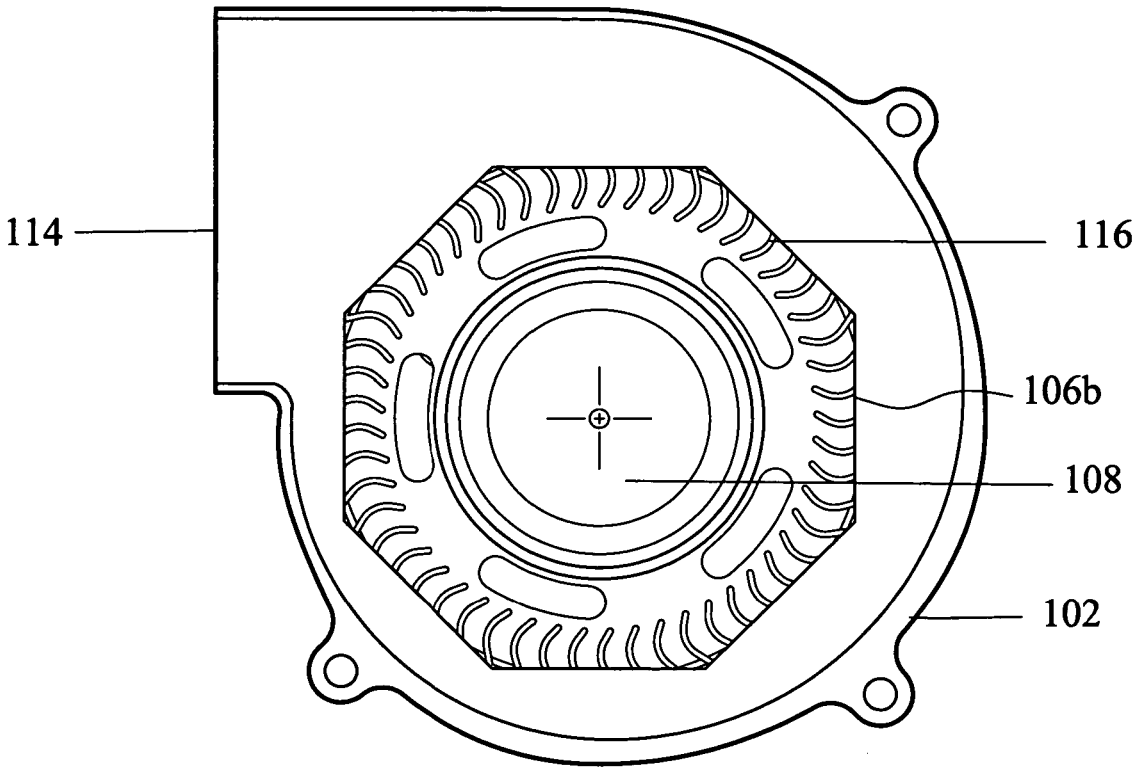
Figure 3C:
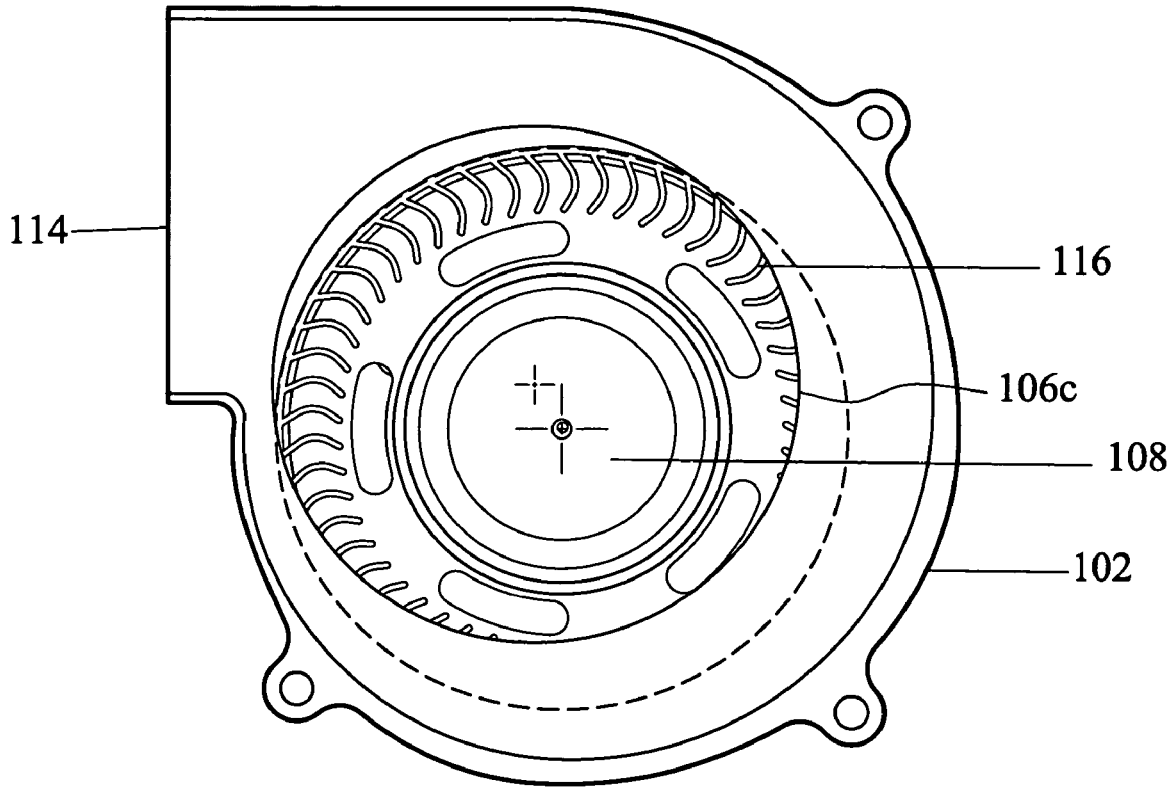

The first inlet 104 formed on the first frames 102*a* comprises a first quadratrical predetermined profile and the second inlet 112 formed on the outer frames 102*b* comprises a second predetermined profile. In the preferred embodiment, the predetermined profile of the first inlet 104 can be elliptical (symbol "106*a*" in FIG. 3A), polygonal (symbol "106*b*" in FIG. 3B), non-coaxial circle (symbol "106*c*" in FIG. 3C), or irregularly closed shaped. The predetermined profile of the second inlet 112 can be quadratrical, elliptical, polygonal, non-coaxial circle, or irregularly closed shaped. The profile of the first inlet 104 can be either the same or different from that of the second inlet 112.

The housing 102 is made from plastic, metal or a composite material and is formed by injection, moldings, pressing, cutting or integrally formed as a single unit.

The impeller 108 comprises a plurality of blades 116 and a driving device (not shown in FIGS.) to rotate the blades 116. An inflow area 110 is encircled by the outer periphery of the blades 116 of the impeller 108. The flow tunnel 118 between the impeller 108 and the housing 102 extends along an axial aspect of the impeller 108 and the housing 102.

The profile of the first and second inlets 104 and 112 do not corresponded to the inflow area 110 of the impeller 108, i.e., the housing 102 partially covers the inflow area 110'. In other embodiments, the first inlet 104 can expose partially or none of the inflow area 110.

When a working fluid, e.g. an air, passes along the flow tunnel 118, the majority of the working fluid is blocked by the housing 102 and is contained in the flow tunnel 118, thus increasing the rotational speed of the impeller 108 and getting a higher air pressure and a better performance.

Note that the number of the first and second inlets 104 and 112 of the housing 102 is not limited to that of the disclosed embodiments. The number of the inlet of the housing 102 can be one or more than two.

Figure 4A:
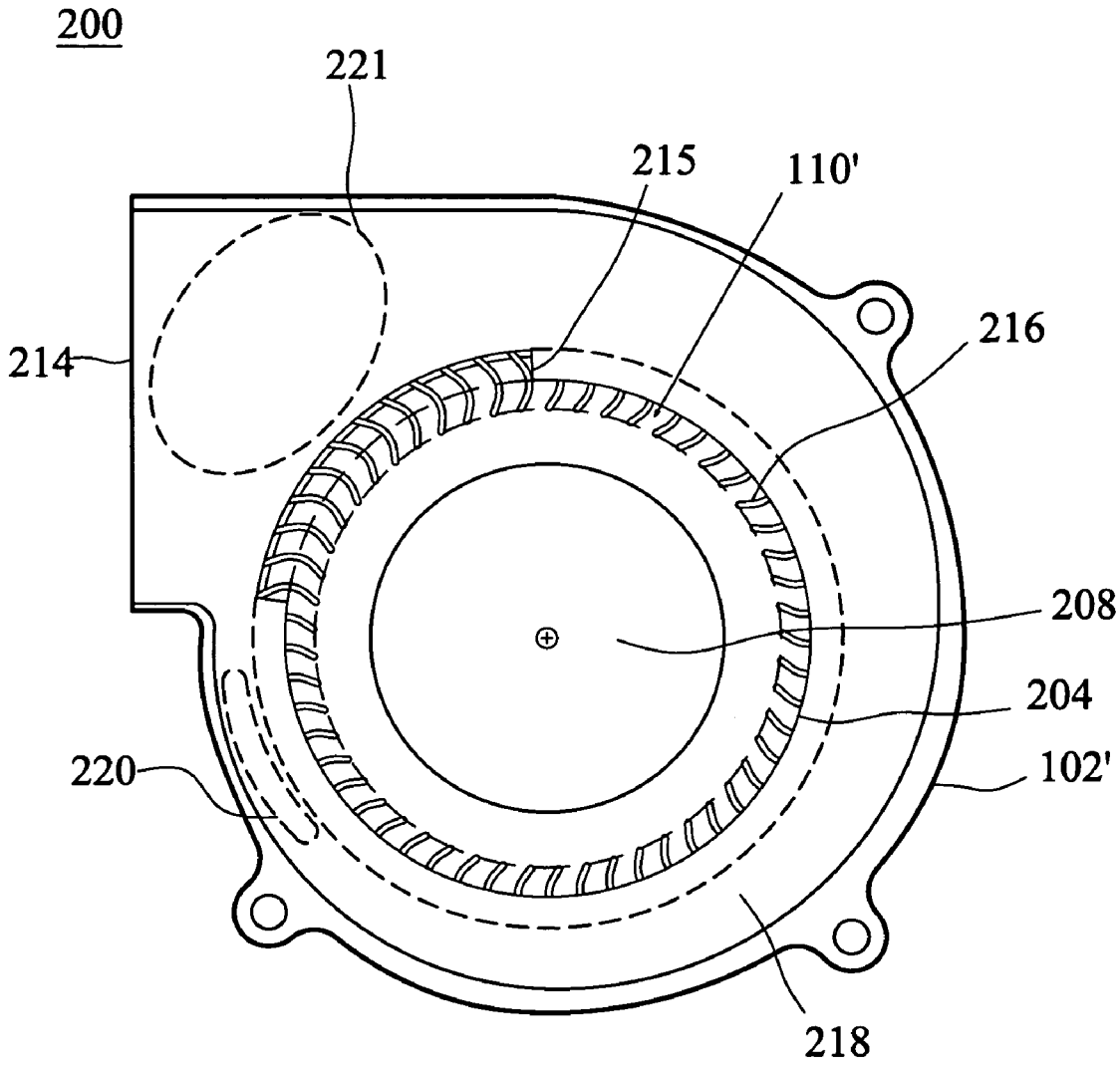
FIGS. 4A and 4B are schematic views of a blower of a second embodiment of the invention.

In FIG. 4A, a blower 200 of the second embodiment comprises a housing 102' assembled by two frames, an impeller 208 disposed in the housing 102', wherein the impeller 208 is disposed in the housing 102. A flow tunnel 218 is formed between the impeller 208 and the housing 102'.

One side of the housing 102' comprises a main inlet 204, an outlet 214, and a secondary inlet 215 extending outwardly from the periphery of the main inlet 204. The main inlet 204 exposes partially or none of the inflow area and the secondary inlet increases an exposed zone of the inflow area.

The impeller 208 comprises a plurality of blades 216, and an inflow area 110 is encircled by the outer periphery of the blades 216 of the impeller 208.

Based on the invention, the flow tunnel 218 can be divided into a high-pressure zone 220, ranging from a narrowest part of the flow tunnel 218 to a designated part thereof, and a low-pressure zone 221 of the flow tunnel 218 that approaches the outlet 214. The designated part generally is determined according to the desired requirement. That is to say, the secondary inlet 215 approaches the outlet 214 and the low-pressure zone 221.

The outer diameter of the main inlet 204 is partially smaller than that of the impeller 208. With the secondary inlet 215, an exposed zone corresponding to the inflow area 110' can be increased.

Note that the secondary inlet 215 located at the low-pressure zone 221 and extends outwardly from the periphery of the axial main inlet 204 to increase the quantity of the inlet.

Figure 4B:
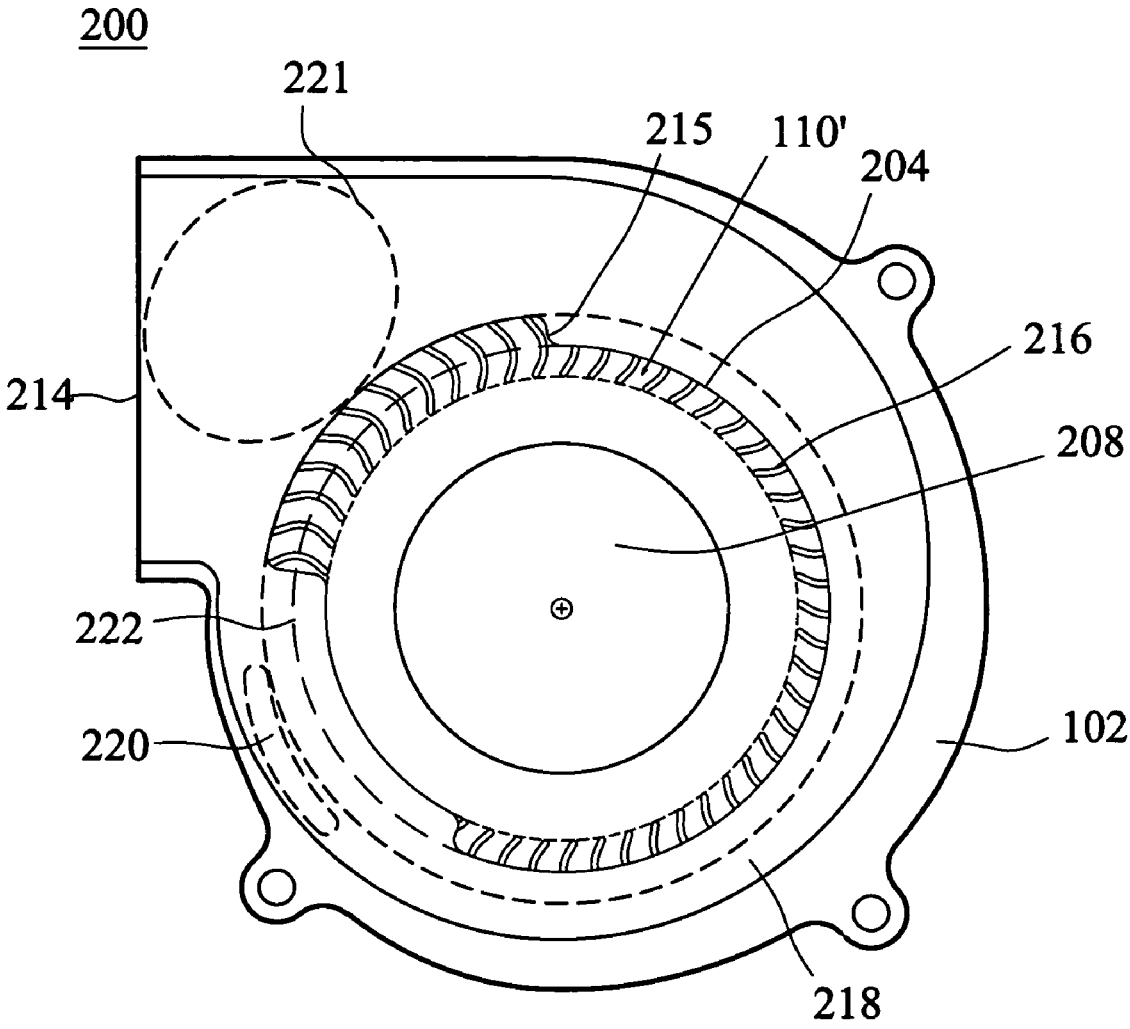

In FIG. 4B, the main inlet 204 comprises a protrusion 222 extending from the periphery of the main inlet 204 toward a center thereof for covering a zone between a narrowest part and a designated part of the flow tunnel 218. The main inlet 204 is slightly smaller than the region encircled by the blades 216 of the impeller 208. If the size of the main inlet 204 and the secondary inlet 215 are reduced with respect to the region encircled by the blades 216 of the impeller 208, the air intake amount remains within a desired range, maintaining the working pressure. In preferred embodiments, the protrusion 222 can be of other shapes to dissipate heat to the exterior.

In the preferred embodiment, the profile of the main inlet 204 can be circular, quadratrical, involute, elliptical, polygonal, eccentrically circular, irregularly closed shaped such as the protrusion 222, regular, or irregular. The profile of the secondary inlet 215 can be regular or irregular.

Based on the described embodiments, the amount of the intake air in the flow tunnel can be increased by utilization of different sizes, shapes or positions of the inlets. When the blower is operated, the majority of working fluid is limited within the flow tunnel, thus increasing the rotational speed of the impeller, maintaining a higher working pressure and a better performance of the blower.

While the invention has been described with respect to preferred embodiment, it is to be understood that the invention is not limited thereto, but, on the contrary, is intended to accommodate various modifications and equivalent arrangements included within the spirit and scope of the appended claims.

What is claimed is:

1. A blower comprising:

a housing comprising an outlet, at least one main inlet and at least one secondary inlet, wherein the secondary inlet extends outwardly from the periphery of the main inlet; and an impeller disposed in the housing, wherein a flow tunnel is formed between the impeller and the housing, wherein the main inlet comprises a protrusion extending toward a center of the main inlet for covering a zone between a narrowest part and a designated part of the flow tunnel.

2. The blower as claimed in claim 1, wherein the secondary inlet approaches the outlet.

3. The blower as claimed in claim 1, further comprising an inflow area, wherein the impeller comprises a plurality of blades and the inflow area is encircled by the outer periphery of the blades of the impeller.

4. The blower as claimed in claim 3, wherein the main inlet exposes some or none of the inflow area and the secondary inlet increases an exposed zone of the inflow area.

5. The blower as claimed in claim 1, wherein the flow tunnel comprises a low-pressure zone approaching the outlet.

6. The blower as claimed in claim 5, wherein the secondary inlet approaches the low-pressure zone.

7. The blower as claimed in claim 1, wherein the profile of the main inlet is circular, elliptical, polygonal, eccentrically circular, or quadratrical.

8. The blower as claimed in claim 1, wherein the profile of the secondary inlet is regular or irregular.

9. The blower as claimed in claim 1, wherein the outer diameter of the main inlet is smaller than that of the impeller.

10. A blower comprising:

a housing comprising an outlet, at least one main inlet and a plurality of secondary inlets, wherein the secondary inlets extending outwardly from the periphery of the main inlet are correspondingly arranged; and an impeller disposed in the housing, wherein a flow tunnel is fanned between the impeller and the housing.

11. The blower as claimed in claim 10, wherein the secondary inlets approach the outlet.

12. The blower as claimed in claim 10, further comprising an inflow area, wherein the impeller comprises a plurality of blades, the inflow area is encircled by the outer periphery of the blades of the impeller, the main inlet exposes some or none of the inflow area and the secondary inlets increase an exposed zone of the inflow area.

13. The blower as claimed in claim 10, wherein the flow tunnel comprises a low-pressure zone approaching the outlet, and the secondary inlets approach the low-pressure zone.

14. The blower as claimed in claim 10, wherein the main inlet comprises a protrusion extending toward a center thereof for covering a zone between a narrowest part and a designated part of the flow tunnel.

15. The blower as claimed in claim 10, wherein the outer diameter of the main inlet is smaller than that of the impeller.

* * * * *